US009257785B2

(12) United States Patent
Sip

(10) Patent No.: US 9,257,785 B2
(45) Date of Patent: Feb. 9, 2016

(54) ELECTRONIC DEVICES AND FOOL-PROOF METHODS

(75) Inventor: Kim Yeung Sip, Taipei Hsien (TW)

(73) Assignee: ACER INCORPORATED, Taipei Hsien (TW)

( * ) Notice: Subject to any disclaimer, the term of this patent is extended or adjusted under 35 U.S.C. 154(b) by 948 days.

(21) Appl. No.: 13/415,613

(22) Filed: Mar. 8, 2012

(65) Prior Publication Data

US 2013/0076328 A1 Mar. 28, 2013

(30) Foreign Application Priority Data

Sep. 23, 2011 (TW) ..... 100134296 A

(51) Int. Cl.
*G05F 3/02* (2006.01)
*H01R 13/62* (2006.01)
*H01R 13/64* (2006.01)

(52) U.S. Cl.
CPC ..... *H01R 13/6205* (2013.01); *H01R 13/64* (2013.01)

(58) Field of Classification Search
CPC ..... H02H 11/00; H02J 9/06; H02J 9/061; H03K 17/0822; H05B 9/08
USPC ..... 307/125
See application file for complete search history.

(56) References Cited

U.S. PATENT DOCUMENTS 2,545,369 A * 3/1951 Millar ..... 324/76.75
4,803,389 A * 2/1989 Ogawa et al. ..... 310/49.55
5,619,137 A * 4/1997 Vig et al. ..... 324/251
6,356,741 B1 * 3/2002 Bilotti ..... H03K 17/9517 307/116
6,515,468 B1 * 2/2003 Morimoto et al. ..... 324/117 H
7,259,531 B1 * 8/2007 Liu ..... 318/400.38
8,251,723 B2 8/2012 Tsai
8,643,453 B2 * 2/2014 Ihara et al. ..... 335/306
2002/0093328 A1 * 7/2002 Maatta ..... G06F 1/1616 324/207.11
2006/0240874 A1 * 10/2006 Yiu ..... 455/566

(Continued)

FOREIGN PATENT DOCUMENTS

DE 94 15 257 1/2005
DE 10 2007 036 053 2/2009

(Continued)

OTHER PUBLICATIONS

Taiwanese language office action dated Nov. 18, 2013.

(Continued)

*Primary Examiner* — Thienvu Tran
*Assistant Examiner* — Brian K Baxter
(74) *Attorney, Agent, or Firm* — McClure, Qualey & Rodack, LLP

(57) ABSTRACT

An electronic device having a fool-proof feature is provided, including a first magnet, an output terminal, a hall sensor and a power supply unit. The first magnet generates a magnetic field. The output terminal is disposed in the range of the magnetic field and is mated with an input terminal of a second electronic device. The hall sensor generates a hall voltage according to the magnetic field. The power supply unit is coupled to the output terminal and provides power to the output terminal according a control signal outputted from the hall sensor, in which the hall sensor outputs the control signal when the output terminal is coupled to the input terminal and the hall voltage exceeds a specific voltage, such that the power supply unit provides power to the output terminal according to the control signal, and the second electronic device receives power from the output terminal.

12 Claims, 9 Drawing Sheets

(56) References Cited

U.S. PATENT DOCUMENTS

| | | | | |
|---|---|---|---|---|
| 2007/0072442 | A1* | 3/2007 | DiFonzo et al. | 439/39 |
| 2007/0252853 | A1* | 11/2007 | Park et al. | 345/649 |
| 2008/0048642 | A1* | 2/2008 | Aratani et al. | 324/117 H |
| 2008/0125932 | A1* | 5/2008 | Yamabe et al. | 701/29 |
| 2009/0058663 | A1* | 3/2009 | Joshi et al. | 340/584 |
| 2010/0207621 | A1* | 8/2010 | Yano | G01R 33/072 324/247 |
| 2010/0261360 | A1 | 10/2010 | Li | |
| 2010/0296260 | A1* | 11/2010 | Chiu | 361/807 |
| 2011/0018528 | A1* | 1/2011 | Semineth et al. | 324/207.25 |
| 2011/0018534 | A1* | 1/2011 | Peukert et al. | 324/251 |
| 2012/0044081 | A1* | 2/2012 | Koppal et al. | 340/686.6 |
| 2012/0154288 | A1* | 6/2012 | Walker | 345/169 |
| 2012/0212913 | A1* | 8/2012 | Qiu et al. | 361/752 |

FOREIGN PATENT DOCUMENTS

| | | |
|---|---|---|
| JP | 1988-156538 | 10/1988 |
| JP | 2004-340782 | 12/2004 |
| JP | 2007-206776 | 8/2007 |
| JP | 2009-199301 | 9/2009 |
| TW | 200820877 | 5/2008 |
| TW | 201029269 | 8/2010 |
| TW | 201036022 | 10/2010 |
| TW | 201041246 | 11/2010 |
| WO | WO 2011/067786 | 6/2011 |

OTHER PUBLICATIONS

English language translation of abstract of JP 2004-340782 (published Dec. 2, 2004).

English language translation of abstract of TW 200820877 (published May 1, 2008).

English language translation of abstract of TW 201029269 (published Aug. 1, 2010).

English language translation of abstract of TW 201036022 (published Oct. 1, 2010).

English language translation of abstract of TW 201041246 (published Nov. 16, 2010).

Japanese language office action dated Aug. 6, 2013.

English language translation of abstract of JP 1988-156538 (published Oct. 13, 1988).

English language translation of abstract of JP 2007-206776 (published Aug. 16, 2007).

English language translation of abstract of JP 2009-199301 (published Sep. 3, 2009).

European Search Report dated Apr. 24, 2013.

Chinese language office action dated Dec. 26, 2014.

Zhang, X., et al.; "The Characteristics of the New Type Hall Sensors and Their Applications in Measurement and Control;" Jun. 2001; pp. 1-9; and the English language translation.

* cited by examiner

ELECTRONIC DEVICES AND FOOL-PROOF METHODS

CROSS REFERENCE TO RELATED APPLICATIONS

This Application claims priority of Taiwan Patent Application No. 100134296, filed on Sep. 23, 2011, the entirety of which is incorporated by reference herein.

BACKGROUND OF THE INVENTION

1. Field of the Invention

The present invention relates to electronic devices, and in particular relates to electronic devices having fool-proof features.

2. Description of the Related Art

Recently, computers and networks make many innovative functions which are more effective. New peripheral devices, such as internet units and external storage unites, can easily be connected to computers or notebooks. However, there are various kinds of peripheral devices, and the plug of the electronic device is often connected to the plug seat in an incorrect manner, such that the electronic device is burnt out after providing power thereto. Therefore, there is a need for an electronic device and a fool-proof method to prevent burnout of the electronic device.

BRIEF SUMMARY OF THE INVENTION

In light of the previously described problems, the invention provides an embodiment of an electronic device having a fool-proof feature, comprising: a first magnet, an output terminal, a hall sensor and a power supply unit. The first magnet generates a magnetic field. The output terminal is disposed in the range of the magnetic field and is mated with an input terminal of a second electronic device. The hall sensor generates a hall voltage according to the magnetic field. The power supply unit is coupled to the output terminal in order to provide power to the output terminal according to a control signal outputted from the hall sensor, in which the hall sensor outputs the control signal when the output terminal is coupled to the input terminal and the hall voltage exceeds a specific voltage, such that the power supply unit provides power to the output terminal according to the control signal, and the second electronic device receives power from the output terminal.

The invention also provides a fool-proof method suitable for a first electronic device and a second electronic device. The fool-proof method comprises the steps of: generating a hall voltage in a hall sensor according to a magnetic field of a first magnet of the first electronic device; determining whether the hall voltage exceeds a specific voltage when an output terminal of the first electronic device is coupled to an input terminal of the second electronic device; and providing power to the output terminal according to a control signal outputted from the hall sensor when the output terminal is coupled to the input terminal and the hall voltage exceeds the specific voltage, such that the second device receives power from the output terminal.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
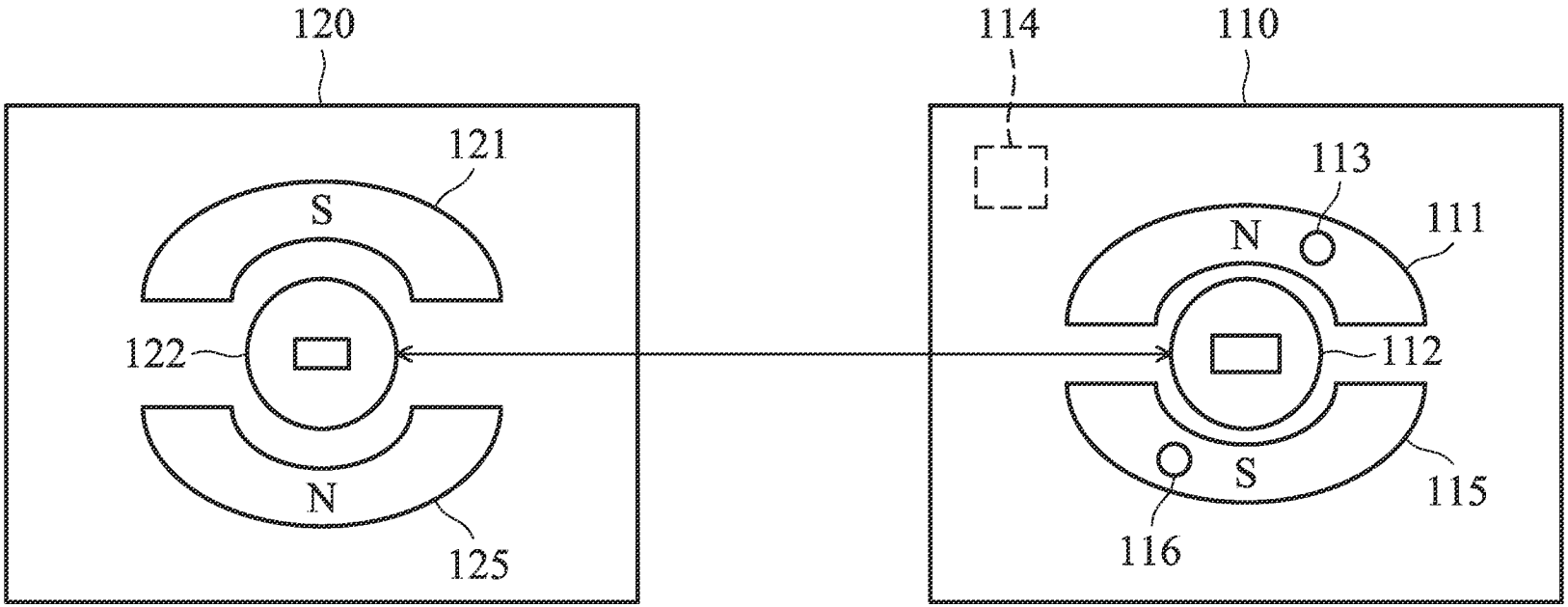
FIG. 1 illustrates a schematic view of the electronic device of the disclosure.

FIG. 1 illustrates a schematic view of the electronic device of the disclosure. As shown in FIG. 1, an electronic device 110 includes magnets 111 and 115, an output terminal 112, a hall sensor 113 (and/or a hall sensor 116) and a power supply unit 114. The magnets 111 and 115 generate magnetic fields. In the embodiment, the magnets 111 and 115 are disposed in two symmetrical sides of the output terminal 112, respectively.

The output terminal 112 is disposed in the range of the magnetic field of the magnet 111, and mated with an input terminal 122 of another electronic device 120. For example, the output terminal 112 can be a female connector and the input terminal 122 can be a male connector. The female connector is mated with the male connector. The hall sensor 113 can be disposed on the magnet 111 in order to generate a hall voltage according to the magnetic field of the magnet 111. In some embodiments, the hall sensor 113 can be disposed on the magnet 115, or the electronic device 110 includes another hall sensor 116 disposed on the magnet 115. The power supply unit 114 is coupled to the output terminal 112. When the output terminal 112 is coupled to the input terminal 122, the power supply unit 114 provides power to the output terminal 112 selectively, such that the input terminal 122 receives power from the output terminal 112. Therefore, the power supply unit 114 can have a switching unit to provide power to the output terminal 112 selectively.

Figure 2:
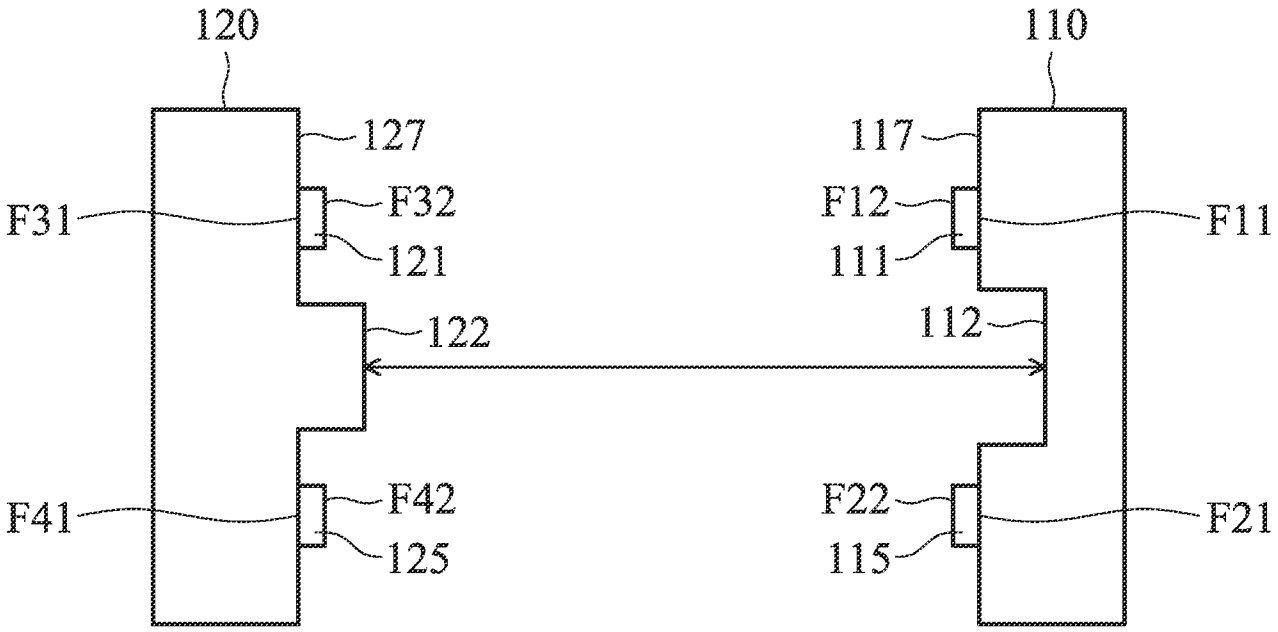
FIG. 2 illustrates another schematic view of the electronic device of the disclosure.

FIG. 2 illustrates another schematic view of the electronic device of the disclosure. As shown in FIG. 2, the magnet 111 has surfaces F11 and F12, and the magnet 115 has surfaces F21 and F22. The surfaces F11 and F21 are disposed on the external housing surface 117. The polarities of the surfaces F11 and F21 are opposite, and the polarities of the surfaces F12 and F22 are opposite. In the other electronic device 120, the magnet 121 has surfaces F31 and F32, and the magnet 125 has surfaces F41 and F42. The surfaces F31 and F41 are disposed on the external housing surface 127. The polarities of the surfaces F31 and F41 are opposite, and the polarities of the surfaces F32 and F42 are opposite.

Figure 3:
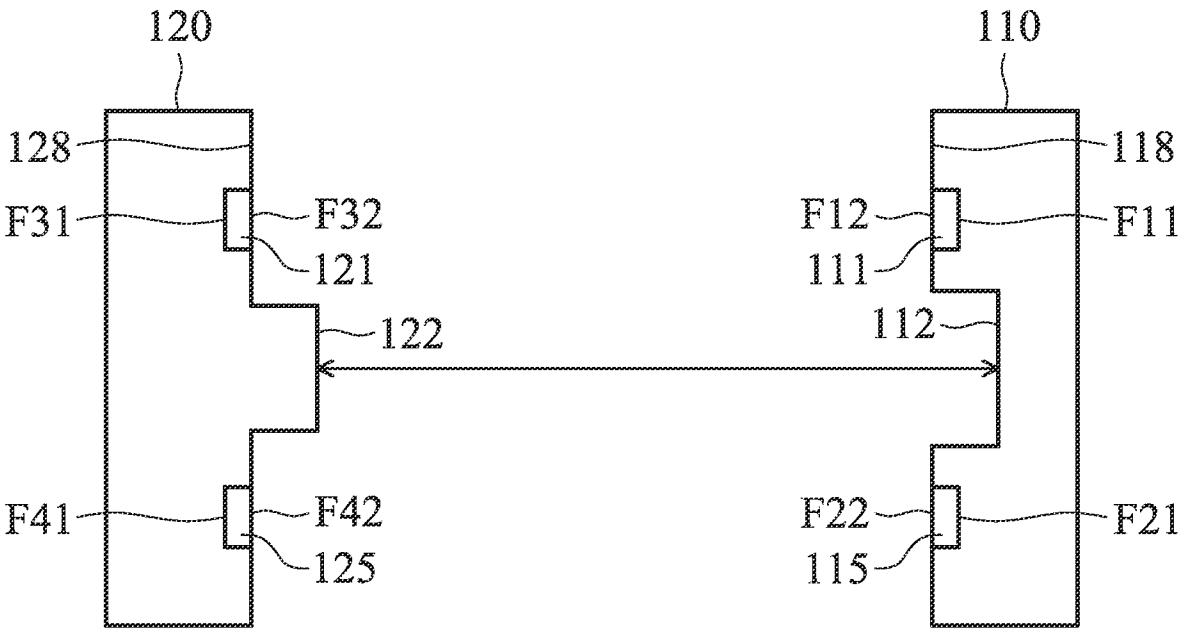
FIG. 3 illustrates another schematic view of the electronic device of the disclosure.

FIG. 3 illustrates another schematic view of the electronic device of the disclosure. FIG. 3 is similar to FIG. 2. The difference is that the surfaces F12 and F22 are both disposed on the internal housing surface 118. In the other electronic device 120, the surfaces F32 and F42 are both disposed on the internal housing surface 128. Note that the magnets 111, 115, 121 and 125 touch the housing surface (e.g., internal housing surface 118 or 128) in FIGS. 3 and 4. In some embodiments, there is spacing between the magnets 111, 115, 121 and 125 and the housing surface (e.g., internal housing surface 118 or 128).

In this embodiment, the magnets 121 and 125 attract the magnets 111 and 115 respectively when the output terminal 112 is coupled to the input terminal 122 normally, such that the magnets 121, 125, 111 and 115 generate the maximum magnetic fields on the hall sensor 113. On the contrary, the magnets 121, 125, 111 and 115 do not generate the maximum magnetic fields on the hall sensor 113 when the output terminal 112 is coupled to the input terminal 122 abnormally.

In detail, the switching unit of the power supply unit 114 is operating an open circuit state when the output terminal 112 is coupled to the input terminal 122 and the hall voltage exceeds the specific voltage, such that the power supply unit 114 can provide power to the output terminal 112. Therefore, the electronic device 120 can receive power from the output terminal 112. In the embodiment, the power supply unit 114 provides power to the output terminal 112 only when the output terminal 112 is coupled to the input terminal 122 and the hall voltage has exceeded the specific voltage for a predetermined period. In other words, only when the output terminal 112 is coupled to the input terminal 122 stably, the power supply unit 114 provides power to the output terminal 112.

When the hall voltage is below the specific voltage, the power supply unit 114 provides no power to the output terminal 112 or stops providing power to the output terminal 112, thereby preventing the electronic devices 110 or 120 from being damaged when the output terminal 112 is coupled to the input terminal 122 abnormally and the power supply unit 114 provides power to the input terminal 122 (the output terminal 112) at the same time.

Figure 4:
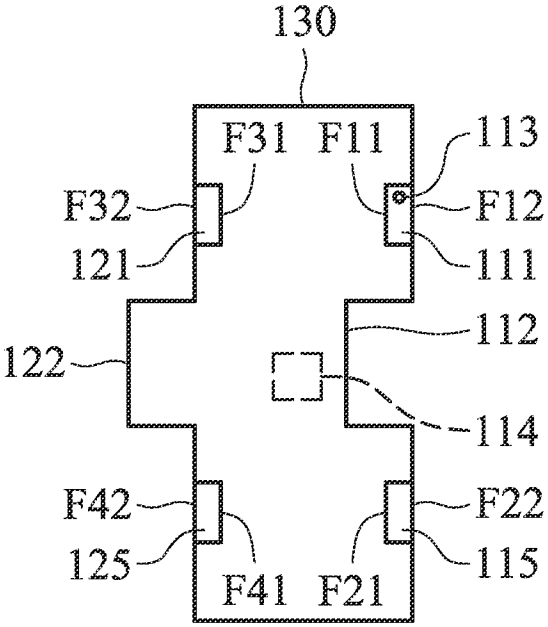
FIG. 4 illustrates another schematic view of the electronic device of the disclosure.

FIG. 4 illustrates another schematic view of the electronic device of the disclosure. The electronic device 130 includes the magnets 111, 115, 121 and 125, the output terminal 112, input terminal 122, the hall sensor 113 and the power supply unit 114. The arrangement of the magnets shown in FIG. 4 is the same as that of the same magnets shown in FIG. 3, and thus, is omitted for brevity. In some embodiments, the arrangement of the magnets shown in FIG. 4 can be the same as that of the same magnets shown in FIG. 2. As shown in FIG. 4, the electronic device 130 includes all features (structures) of the electronic devices 110 and 120.

Figure 5:
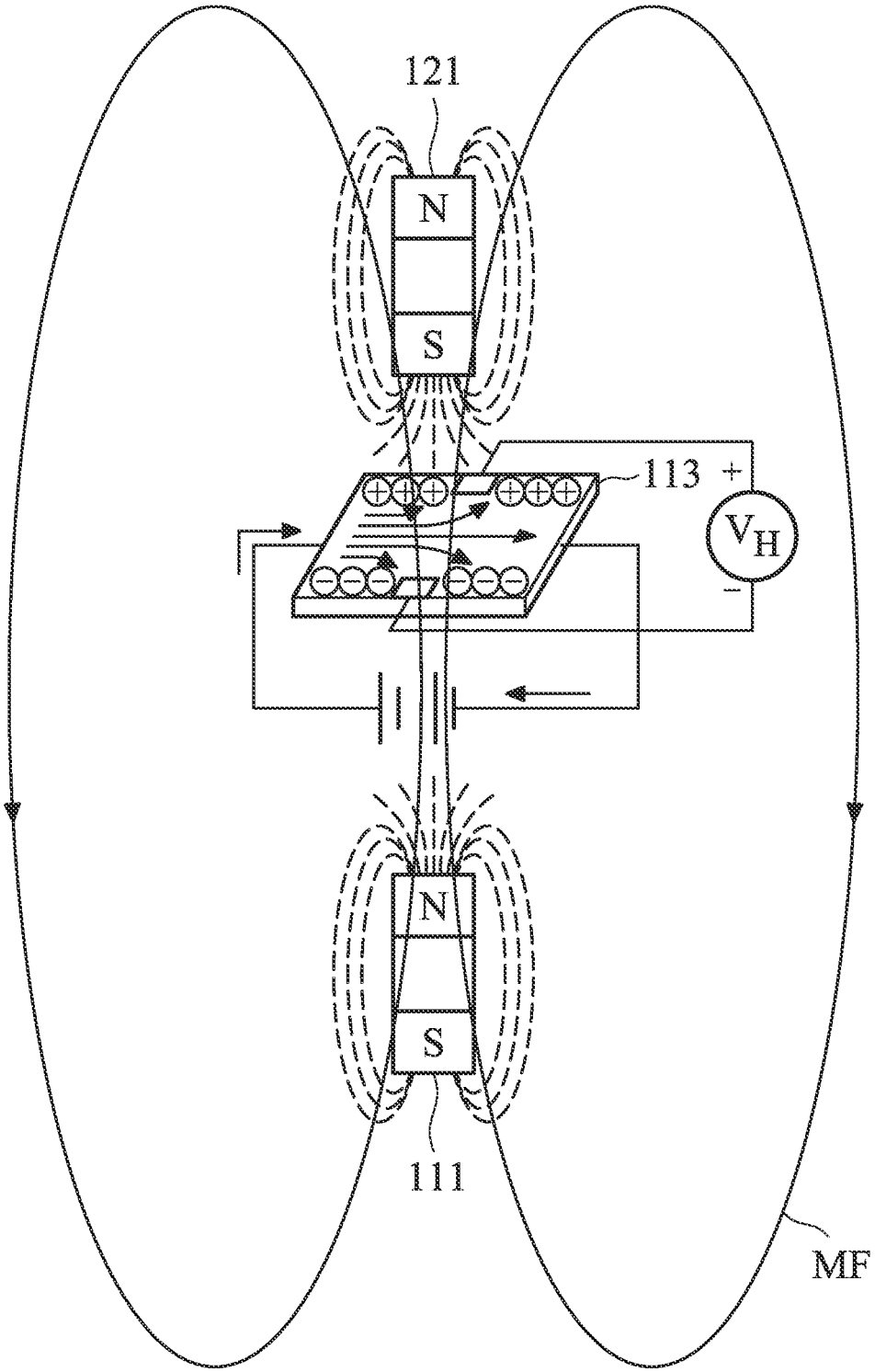
FIG. 5 illustrates a schematic view of the hall sensor of the disclosure.

FIG. 5 illustrates a schematic view of the hall sensor of the disclosure. As shown in FIG. 5, the magnet 121 increases (enhances) the amount of the magnetic field MF when the output terminal 112 is coupled to the input terminal 122 normally, such that the hall voltage VH exceeds the specific voltage. When the hall voltage VH has exceeded the specific voltage for the predetermined period, the hall sensor 113 outputs the control signal to the power supply unit 114, such that the power supply unit 114 provides power to the output terminal 112 according to the control signal.

Figure 6:
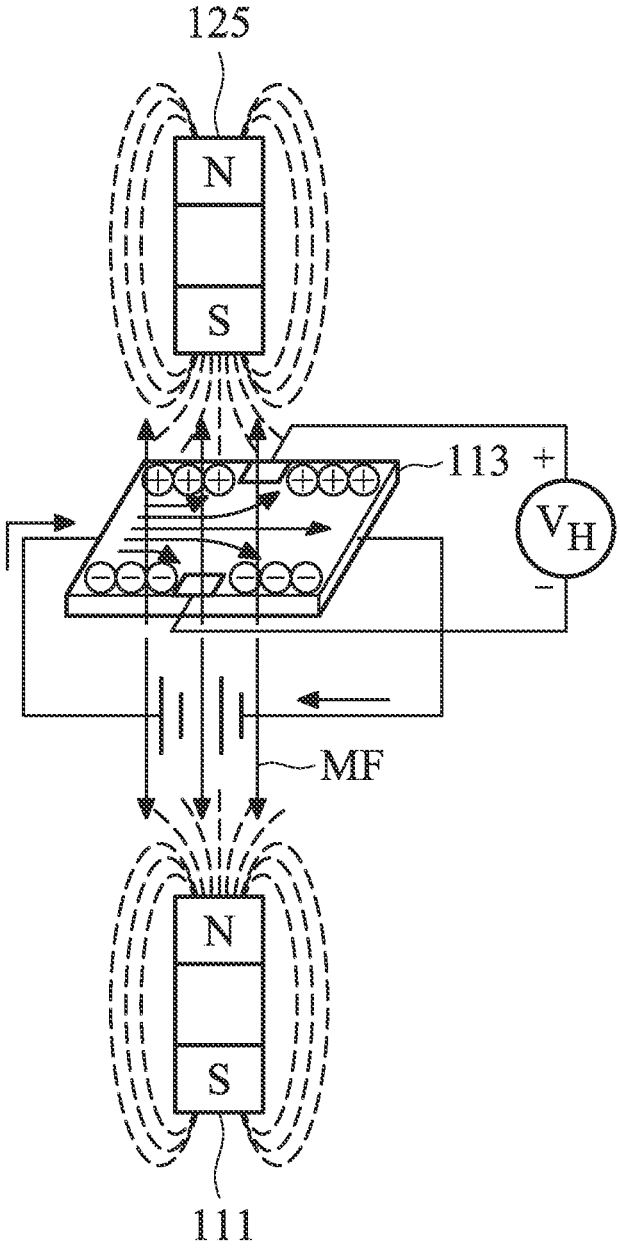
FIG. 6 illustrates another schematic view of the hall sensor of the disclosure.

FIG. 6 illustrates another schematic view of the hall sensor of the disclosure. As shown in FIG. 6, the magnet 125 decreases amount of the magnetic field MF when the output terminal 112 is coupled to the input terminal 122 abnormally, such that the hall voltage VH cannot be increased to the specific voltage. Therefore, the hall sensor 113 is unable to output the control signal to the power supply unit 114, so that the power supply unit 114 is unable to provide power to the output terminal 112.

Figure 7:
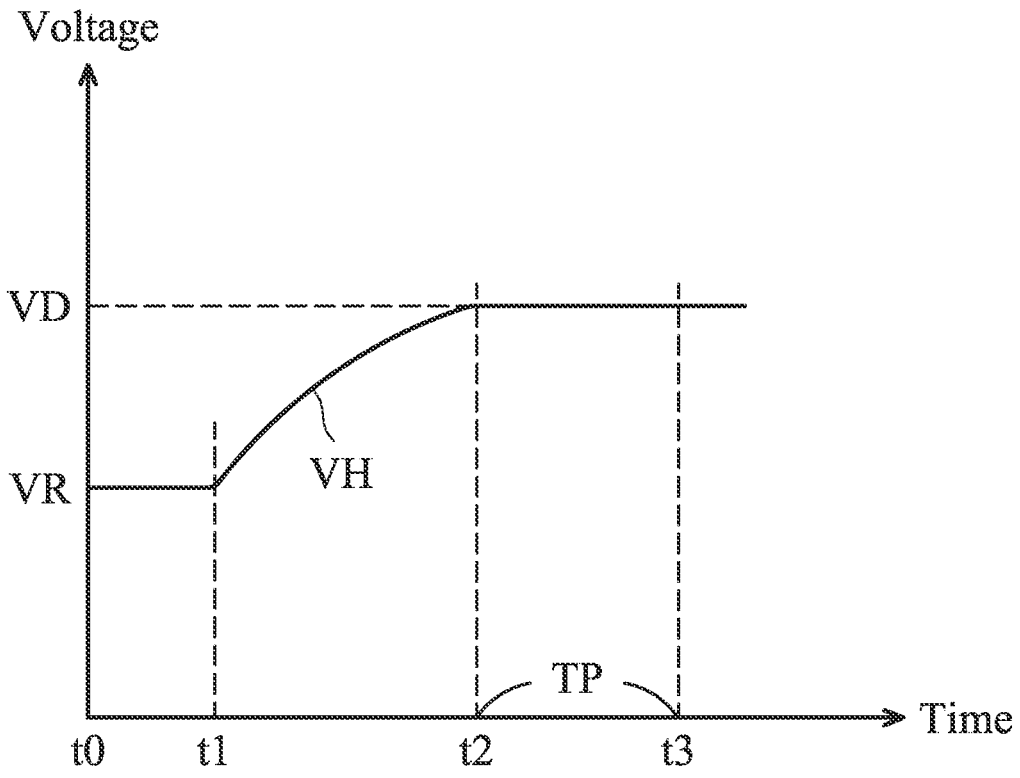
FIG. 7 illustrates a timing chart of the hall voltage of the disclosure.

FIG. 7 illustrates a timing chart of the hall voltage of the disclosure. As shown in FIG. 7, at time point t0, the hall sensor 113 generates the hall voltage VH according to the magnetic field MF. At this moment, amount of the hall voltage VH is the voltage VR. At time point t1, the output terminal 112 is coupled to the input terminal 122 correctly, such that the magnet 121 increases the hall voltage VH. At time point t2, the hall voltage VH exceeds a specific voltage VD, in which the specific voltage VD is above the voltage VR. When the process goes through a predetermined period to the time point t3 and the hall voltage VH still exceeds the specific voltage VD, the hall sensor 113 outputs the control signal to the power supply unit 114, such that the power supply unit 114 provides power to the output terminal 112 according to the control signal.

Figure 8:
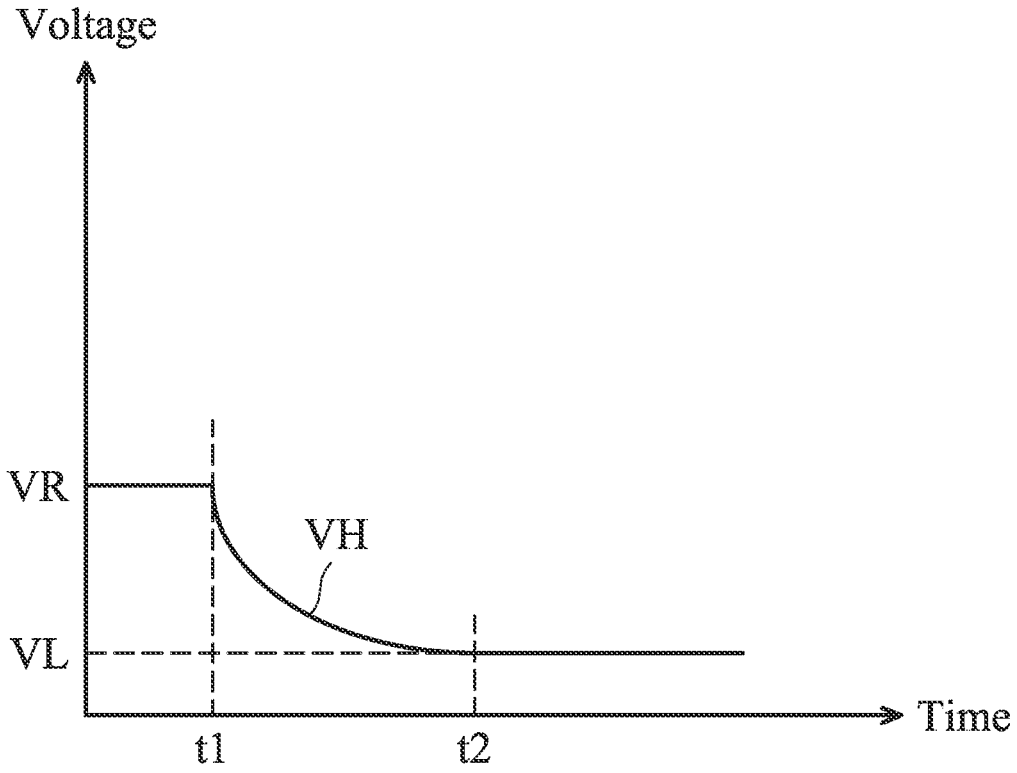
FIG. 8 illustrates another timing chart of the hall voltage of the disclosure.

FIG. 8 illustrates another timing chart of the hall voltage of the disclosure. As shown in FIG. 8, at time point t1, the magnet 125 can decreases the amount of the magnetic field MF when the output terminal 112 is coupled to the input terminal 122 abnormally (incorrectly), such that the hall voltage is unable to be increased. At time point t2, the hall voltage VH drops below the voltage VL, in which the voltage VR is above the voltage VL. Therefore, the hall sensor 113 cannot output a control signal to the power supply unit 114, such that the power supply unit 114 is unable to provide power to the output terminal 112.

Figure 9:
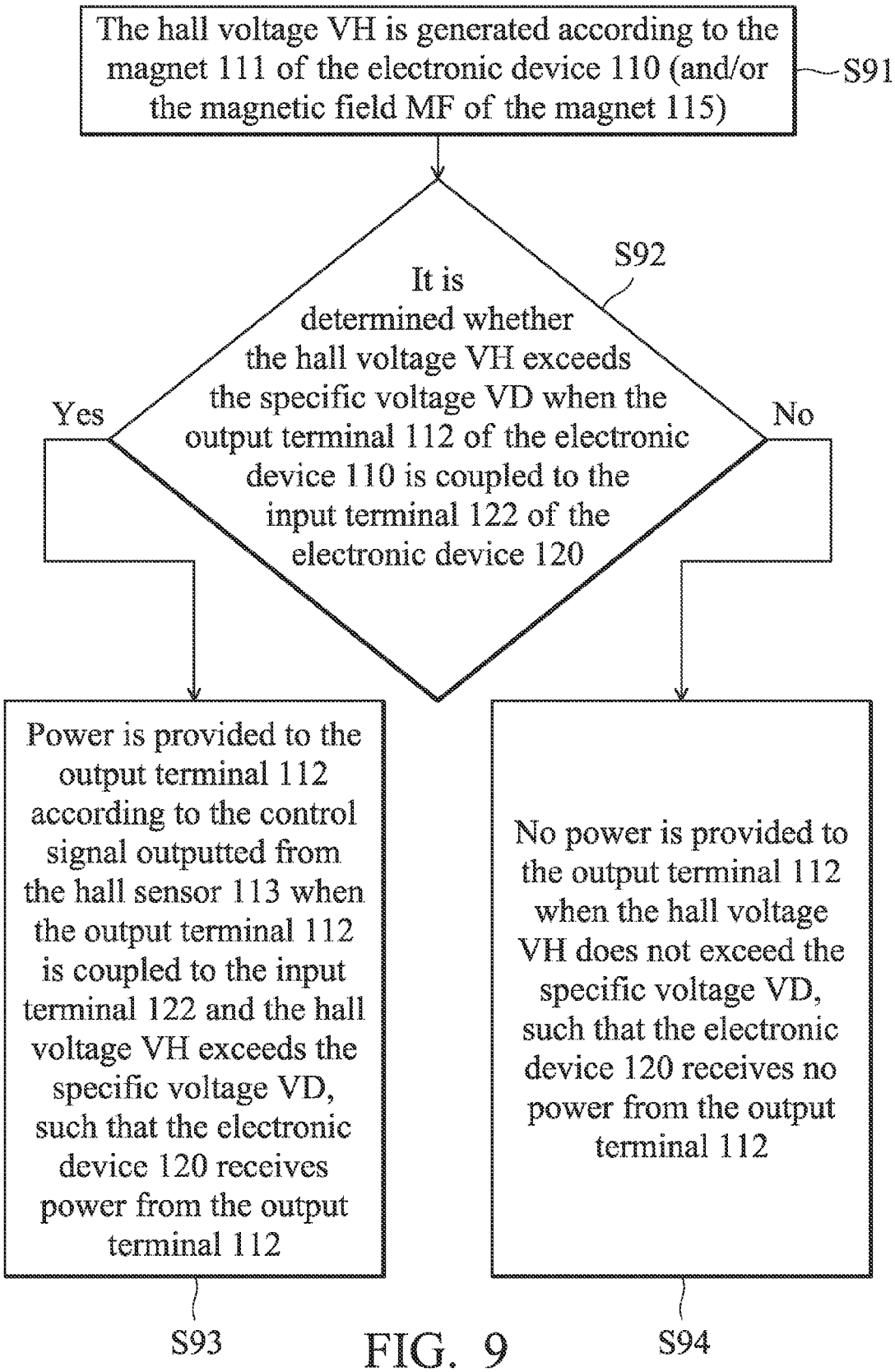
FIG. 9 illustrates a flowchart of the fool-proof method of the disclosure.

FIG. 9 illustrates a flowchart of the fool-proof method of the disclosure. As shown in FIG. 9, in step S91, the hall voltage VH is generated according to the magnet 111 of the electronic device 110 (and/or the magnetic field MF of the magnet 115). In step S92, it is determined whether the hall voltage VH exceeds the specific voltage VD when the output terminal 112 of the electronic device 110 is coupled to the input terminal 122 of the electronic device 120. In step S93, power is provided to the output terminal 112 according to the control signal outputted from the hall sensor 113 when the output terminal 112 is coupled to the input terminal 122 and the hall voltage VH exceeds the specific voltage VD, such that the electronic device 120 receives power from the output terminal 112. In step S94, no power is provided to the output terminal 112 when the hall voltage VH does not exceed the specific voltage VD, such that the electronic device 120 receives no power from the output terminal 112.

The electronic device and the fool-proof method of the disclosure can determine whether the electronic device 110 is electrically connected to the electronic device 120 in a correct way, in order to prevent partial components of the electronic device 120 from being damaged or being burnt out when the electronic device 110 is electrically connected to the electronic device 120 with an incorrect way. Therefore, the electronic device and the fool-proof method of the disclosure can protect the electronic device 120 effectively.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An electronic device having a fool-proof feature, comprising:

a first magnet, generating a magnetic field;

an output terminal, disposed in the range of the magnetic field and mated with an input terminal of a second electronic device, wherein the input terminal and the output terminal are detachable;

a hall sensor, generating a hall voltage according to the magnetic field; and a power supply unit, coupled to the output terminal in order to provide power to the output terminal according to a control signal outputted from the hall sensor, wherein the hall sensor outputs the control signal when the output terminal is coupled to the input terminal and the hall voltage exceeds a specific voltage, such that the power supply unit provides power to the output terminal according to the control signal, and the second electronic device receives power from the output terminal, wherein the hall sensor stops outputting the control signal when the hall voltage does not exceed the specific voltage, such that the power supply unit is unable to provide power to the output terminal, wherein a second magnet of the second electronic device increases the hall voltage to the specific voltage when the output terminal is coupled to the input terminal correctly, such that the hall sensor outputs the control signal, and the power supply unit provides power to the output terminal according to the control signal.

2. The electronic device as claimed in claim 1, wherein the hall sensor outputs the control signal when the hall voltage has exceeded the specific voltage for a predetermined period.

3. The electronic device as claimed in claim 1, wherein the first magnet is repelled by a third magnet of the second electronic device and the third magnet decreases the hall voltage when the input terminal is connected to the output terminal abnormally, such that the hall sensor stops outputting the control signal.

4. The electronic device as claimed in claim 1, wherein the hall sensor is disposed on the first magnet.

5. The electronic device as claimed in claim 1, wherein the input terminal is a male connector and the output terminal is a female connector.

6. The electronic device as claimed in claim 1, wherein the second magnet of the second electronic device attracts the first magnet, and the hall sensor generates the hall voltage according to the magnetic field between the first magnet and the second magnet.

7. A fool-proof method, suitable for a first electronic device and a second electronic device, comprising:

generating a hall voltage in a hall sensor according to a magnetic field of a first magnet of the first electronic device;

determining whether the hall voltage exceeds a specific voltage when an output terminal of the first electronic device is coupled to an input terminal of the second electronic device, wherein the input terminal and the output terminal are detachable;

providing power to the output terminal according to a control signal outputted from the hall sensor when the output terminal is coupled to the input terminal and the hall voltage exceeds the specific voltage, such that the second electronic device receives power from the output terminal; and stopping the providing of power to the output terminal when the hall voltage does not exceed the specific voltage, such that the second electronic device receives no power from the output terminal, wherein a second magnet of the second electronic device increases the hall voltage to the specific voltage when the input terminal is coupled to the output terminal normally, such that the hall sensor outputs the control signal, thereby a power supply unit of the first electronic device provides power to the output terminal according to the control signal.

8. The fool-proof method as claimed in claim 7, wherein the hall sensor outputs the control signal when the hall voltage has exceeded the specific voltage for a predetermined period.

9. The fool-proof method as claimed in claim 7, wherein the first magnet is repelled by a third magnet of the second electronic device and the third magnet decreases the hall voltage when the output terminal is connected to the input terminal abnormally, such that the hall sensor stops outputting the control signal.

10. The fool-proof method as claimed in claim 7, wherein the hall sensor is disposed on the first magnet.

11. The fool-proof method as claimed in claim 7, wherein the input terminal is a male connector and the output terminal is a female connector.

12. The fool-proof method as claimed in claim 7, wherein the second magnet of the second electronic device attracts the first magnet, and the hall sensor generates the hall voltage according to the magnetic field between the first magnet and the second magnet.

* * * * *